US011542764B2

(12) United States Patent
Sandhu

(10) Patent No.: US 11,542,764 B2
(45) Date of Patent: Jan. 3, 2023

(54) LATCHING APPARATUS AND METHOD

(71) Applicant: CORDAX EVALUATION TECHNOLOGIES INC., Calgary (CA)

(72) Inventor: Charanjit Singh Sandhu, Calgary (CA)

(73) Assignee: Cordax Evaluation Technologies Inc., Calgary (CA)

( * ) Notice: Subject to any disclaimer, the term of this patent is extended or adjusted under 35 U.S.C. 154(b) by 0 days.

(21) Appl. No.: 16/901,625

(22) Filed: Jun. 15, 2020

(65) Prior Publication Data

US 2020/0408053 A1 Dec. 31, 2020

Related U.S. Application Data

(60) Provisional application No. 62/861,854, filed on Jun. 14, 2019.

(51) Int. Cl.

| | |
|---|---|
| ***E21B 23/02*** | (2006.01) |
| ***E21B 23/08*** | (2006.01) |
| ***E21B 47/01*** | (2012.01) |

(52) U.S. Cl.

CPC ..... *E21B 23/02* (2013.01); *E21B 23/08* (2013.01); *E21B 47/01* (2013.01)

(58) Field of Classification Search

CPC ..... E21B 17/1021; E21B 23/01; E21B 23/02; E21B 23/08; E21B 23/14; E21B 47/01

See application file for complete search history.

(56) References Cited

U.S. PATENT DOCUMENTS

| | | | | | |
|---|---|---|---|---|---|
| 2,251,125 | A * | 7/1941 | Gardner | E21B 47/01 | 166/215 |
| 2,719,361 | A * | 10/1955 | Montgomery | E21B 47/08 | 33/544.3 |
| 2,991,835 | A * | 7/1961 | Schwab | E21B 23/02 | 166/214 |
| 3,027,947 | A * | 4/1962 | Fredd | E21B 23/02 | 166/214 |
| 3,050,143 | A * | 8/1962 | Kammerer | E21B 10/66 | 175/261 |
| 3,208,531 | A * | 9/1965 | Tamplen | E21B 23/02 | 166/125 |
| 3,638,723 | A * | 2/1972 | Carroll | E21B 23/02 | 166/215 |
| 4,262,702 | A * | 4/1981 | Streich | E21B 33/1265 | 138/89 |
| 4,750,559 | A * | 6/1988 | Greenlee | E21B 23/01 | 166/216 |

(Continued)

FOREIGN PATENT DOCUMENTS

| | | | | |
|---|---|---|---|---|
| CA | 2841639 | A1 * | 8/2014 | E21B 17/10 |
| EP | 0683304 | A2 * | 11/1995 | E21B 49/08 |

(Continued)

*Primary Examiner* — Jennifer H Gay

(74) *Attorney, Agent, or Firm* — Bennett Jones LLP

(57) ABSTRACT

A latching apparatus includes a body, a fin biased to protrude from the body, and a biasing element for so biasing the fin. A method for securing a tool in a drilling tubular includes connecting the tool to a latching apparatus, the latching apparatus including a fin biased to protrude radially outward, forcing the latching apparatus into the drilling tubular, and forcing the latching apparatus through a landing ring.

7 Claims, 10 Drawing Sheets

(56) References Cited

U.S. PATENT DOCUMENTS

| | | | | |
|---|---|---|---|---|
| 6,425,449 | B1 * | 7/2002 | Marshall | E21B 25/02 175/236 |
| 7,886,834 | B2 * | 2/2011 | Spencer | E21B 33/129 166/382 |
| 9,103,178 | B2 * | 8/2015 | Beach | E21B 31/20 |
| 9,976,407 | B2 * | 5/2018 | Ash | E21B 23/02 |
| 10,030,460 | B2 * | 7/2018 | Beach | E21B 25/02 |
| 10,287,834 | B2 * | 5/2019 | Chaplin | E21B 23/00 |
| 2009/0071659 | A1 * | 3/2009 | Spencer | E21B 23/01 166/382 |
| 2010/0126734 | A1 * | 5/2010 | Eriksen | E21B 10/64 166/385 |
| 2012/0074722 | A1 * | 3/2012 | Beach | E21B 25/02 294/86.1 |
| 2012/0298378 | A1 * | 11/2012 | McCauley | E21B 23/01 166/382 |
| 2014/0238660 | A1 * | 8/2014 | Ash | E21B 33/126 166/101 |
| 2015/0068737 | A1 * | 3/2015 | Ash | E21B 47/01 166/250.01 |
| 2015/0275603 | A1 * | 10/2015 | Beach | E21B 25/02 175/246 |
| 2016/0186512 | A1 * | 6/2016 | Chaplin | E21B 23/01 166/206 |
| 2020/0408053 | A1 * | 12/2020 | Sandhu | E21B 23/08 |

FOREIGN PATENT DOCUMENTS

| | | | | |
|---|---|---|---|---|
| GB | 2533779 | A * | 7/2016 | E21B 17/1021 |
| WO | WO-9708417 | A1 * | 3/1997 | E21B 10/66 |
| WO | WO-2010114383 | A1 * | 10/2010 | E21B 23/02 |

* cited by examiner

LATCHING APPARATUS AND METHOD

BENEFIT OF EARLIER APPLICATIONS

This application claims priority from U.S. provisional application 62/861,854, filed Jun. 14, 2019.

TECHNICAL FIELD

The present invention relates to latching equipment in general, and downhole latching equipment in particular.

BACKGROUND

Logging while tripping (LWT) technology provides a way to monitor, record, and evaluate data during a drilling operation. For example, LWT may monitor an open-hole wellbore operation by using logging tools positioned within drill collars of a drill string in the wellbore.

Logging tools are used to measure downhole physical properties of the formation as the drill string, together with the logging tools at a landing ring inside the drill string above the bit, are pulled out of the hole. This operation is referred to as "tripping out." Various drilling operations and conditions may cause the tools to come out of alignment. Therefore, there is a need for a device able to convey and releasably secure logging tools to a landing element to be connected in a stable way.

SUMMARY OF INVENTION

In accordance with a broad aspect of the present invention, there is provided a latching apparatus, comprising: a body; a fin, biased to protrude from the body; and a biasing element, having a first end coupled to the fin and a second end coupled to the body, for biasing the fin radially from the body.

In accordance with another broad aspect of the present invention, there is provided a method for securing a tool in a drilling tubular, comprising: connecting the tool to a latching apparatus; pumping the latching apparatus into the drilling tubular; resiliently biasing a fin of the latching apparatus radially outward; and forcing the latching apparatus through a landing ring, during which the landing ring forces the fin to move inward to a withdrawn position, and following which the landing ring may resiliently return to an expanded position.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

(a) FIG. 1. is a side elevation view of a latching apparatus according to one embodiment of the present invention.

(b)

(c)

(d)

(e)

(f)

(g)

(h)

(i)

(j)

(k)

(l)

(m)

(n)

(o)

(p)

(q)

DETAILED DESCRIPTION OF EMBODIMENTS

Figure 1:
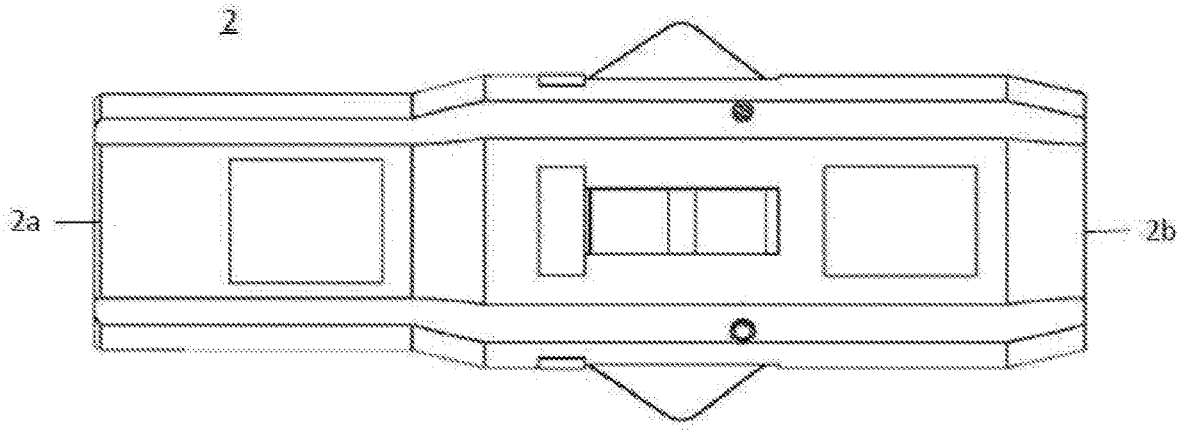
Figure 2:
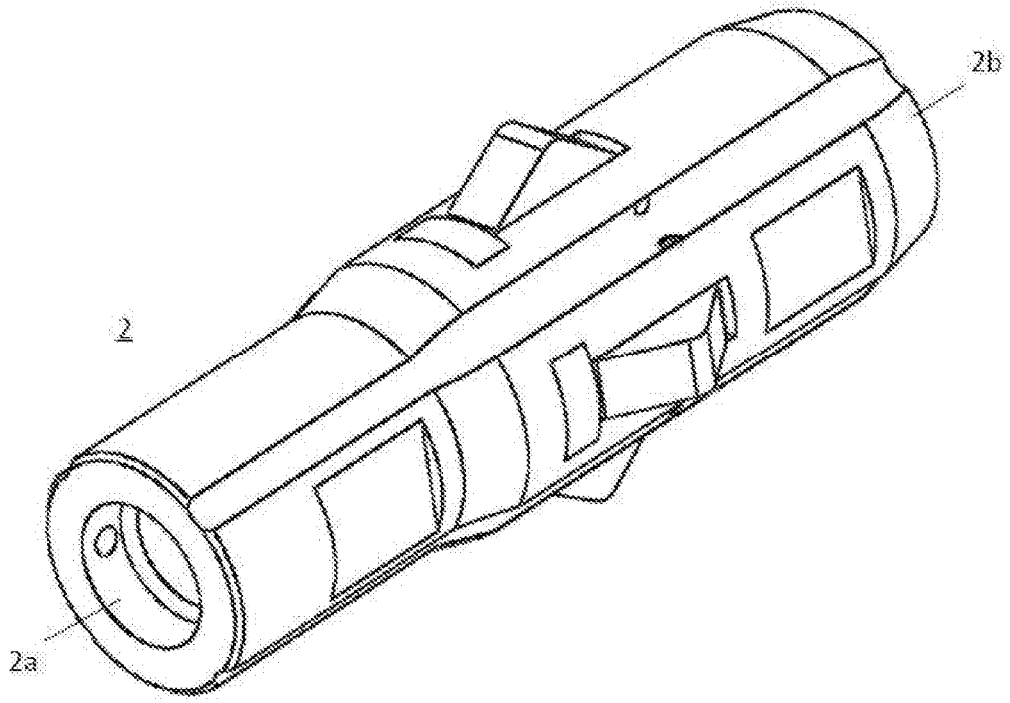
FIG. 2 is a side perspective view of the embodiment of FIG. 1.
Figure 3A:
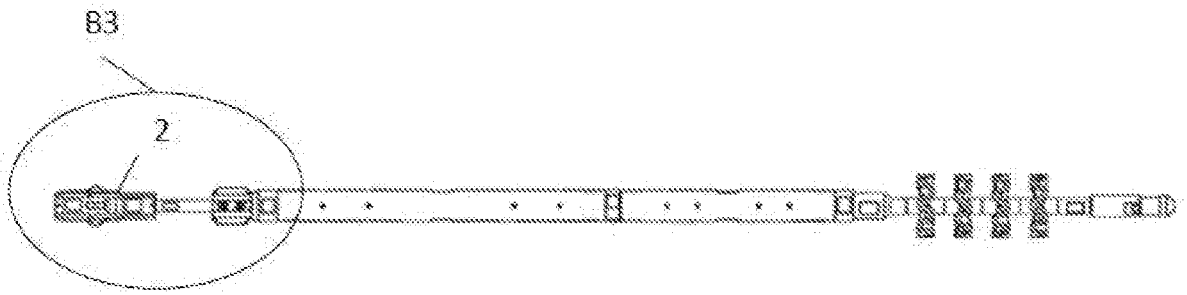
FIG. 3A is a side elevation view of the embodiment of FIG. 1 coupled to a pumpdown assembly.
Figure 3B:
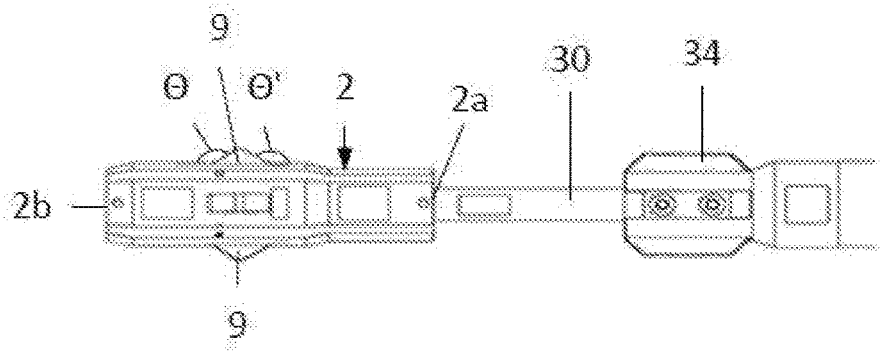
FIG. 3B is an enlarged view of area B3 of FIG. 3A.
Figure 4A:
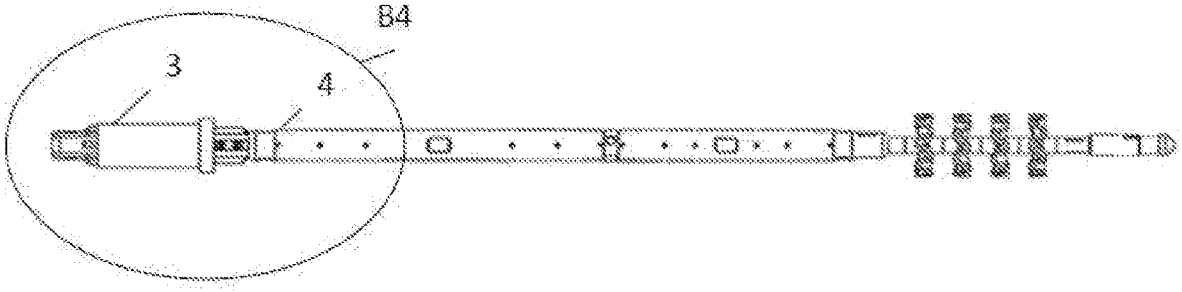
FIG. 4A is a side elevation view of the embodiment of FIG. 3A locked within a landing ring.
Figure 4B:
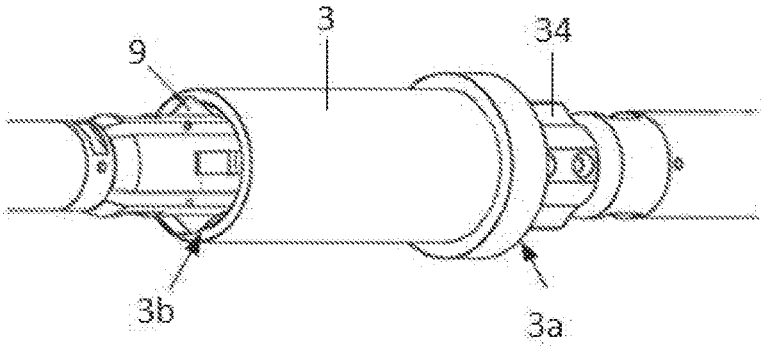
FIG. 4B is a side perspective view of area B4 of FIG. 4A.
Figure 5A:
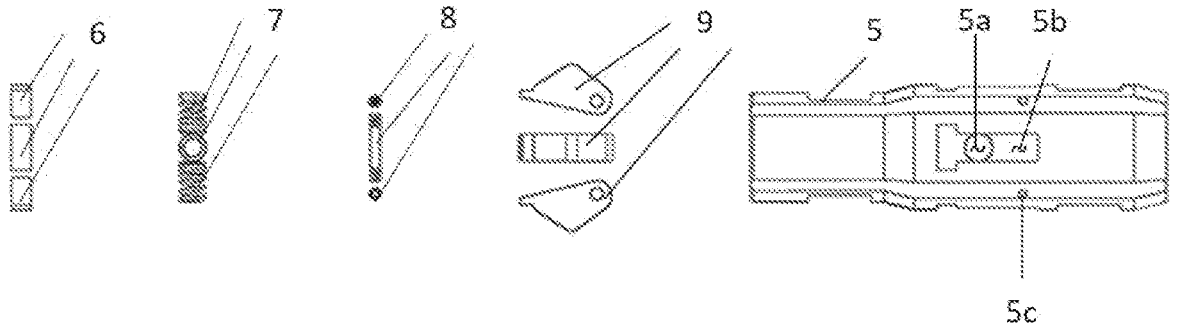
FIG. 5A is an exploded side elevation view of the embodiment of FIG. 1.
Figure 5B:
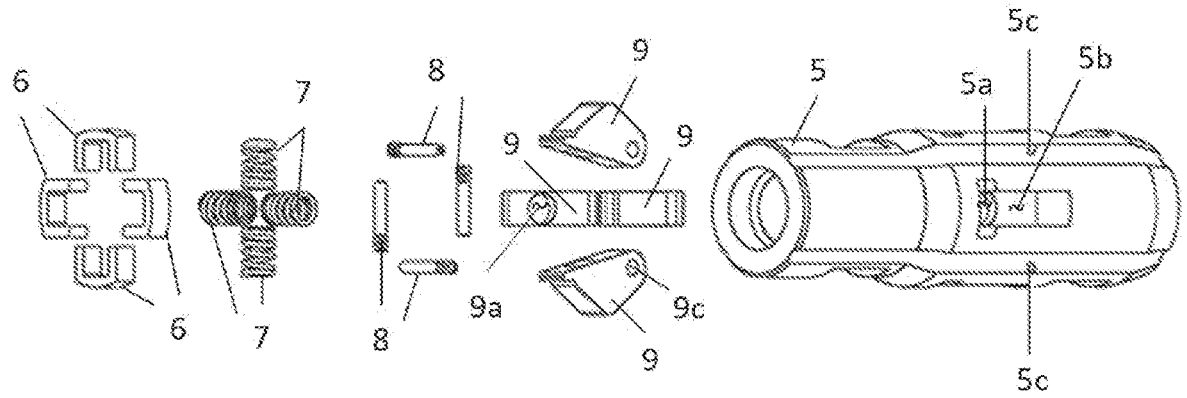
FIG. 5B is an exploded side perspective view of the embodiment of FIG. 1.
Figure 5C:
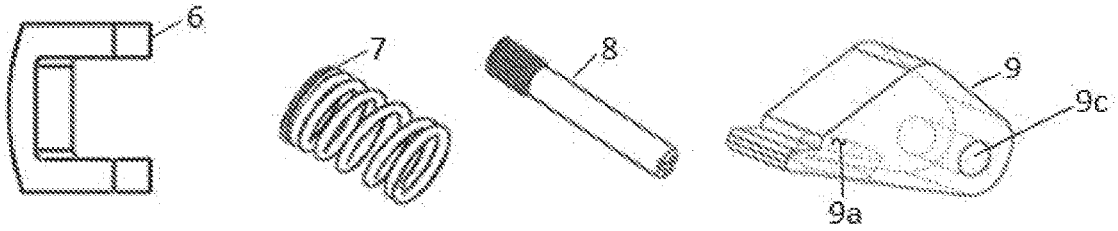
FIG. 5C is an exploded side perspective view of the latching fin holder, spring, fin holder rod, and fin of the embodiment of FIG. 1.
Figure 5D:
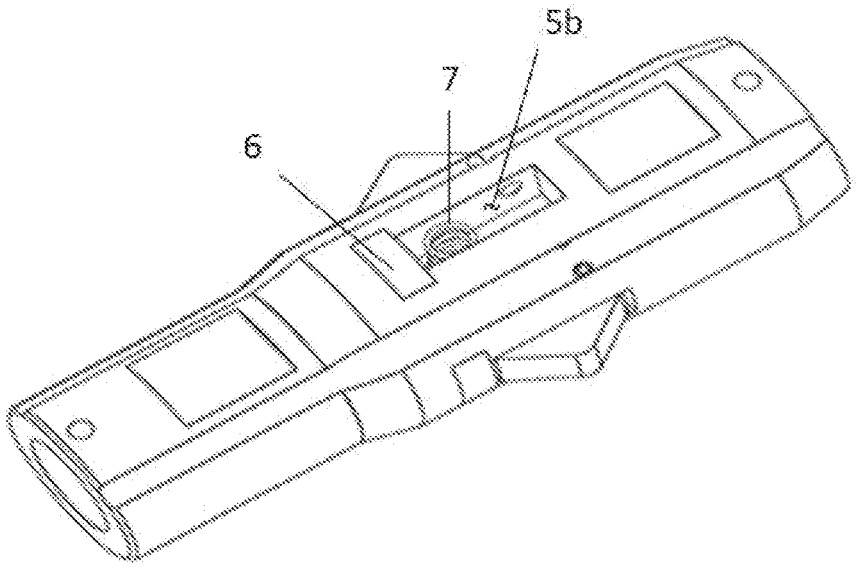
FIG. 5D is a side perspective view of the embodiment of FIG. 1 with one of the tins removed to show the spring position, and tin holder rod holes position, in the body-fin recession.
Figure 6:
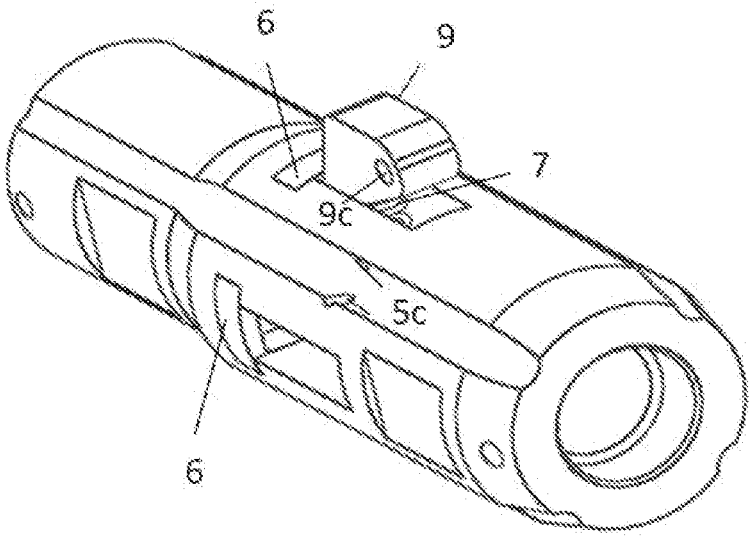
FIG. 6 is a side perspective view of the embodiment of FIG. 1 with latching fins partly removed.
Figure 7A:
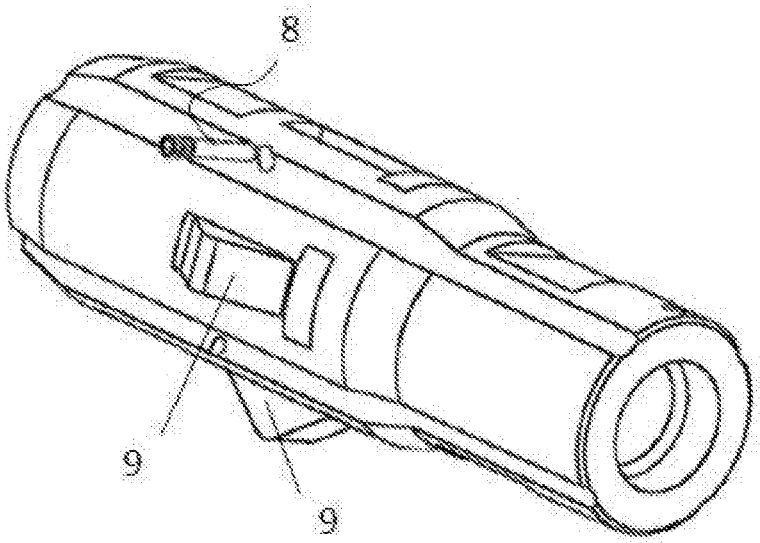
FIGS. 7A-B are a side perspective views of the embodiment of FIG. 1 with fins partially installed.
Figure 7B:
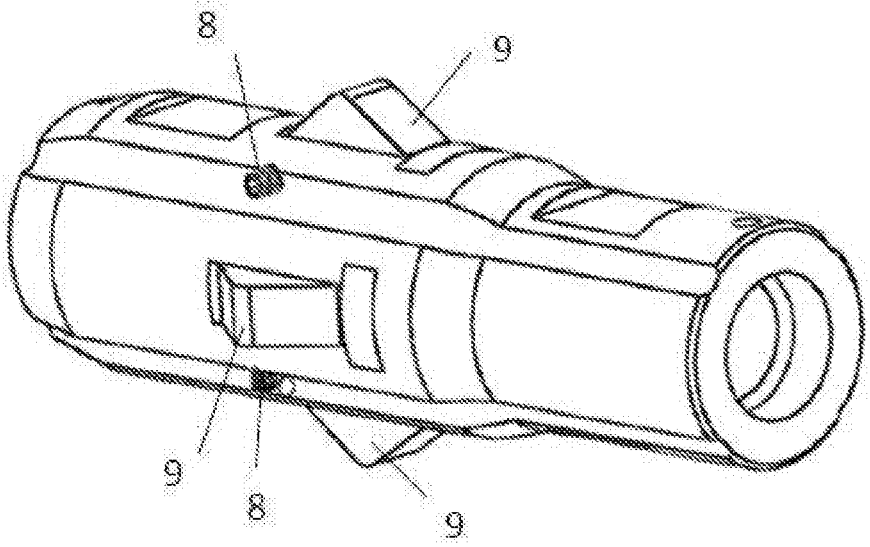

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

LWT uses relatively small diameter logging tools that are conveyed downhole through the drill pipe by pumping a tool string down a drilling tubular to LWT collars, which are often selected to be opaque or transparent (relatively) to radiation types emitted by LWT tools into adjacent formations, and to reflected, reactive or refracted resulting radiation sensed by the LWT tools. The LWT collars may be connected to each other and/or to a landing element (such as a landing ring) in the bottom hole assembly (BHA). The landing ring may be positioned between collar connections of the BHA. The landing ring may be an elongate tubular member. The rig drills to the selected depth, and when the bit is at the a desired position within the borehole, before the drill pipe is pulled (or pulled further) out of the hole, the logging tools are pumped down, from the surface through the drill pipe until the tool string reaches the landing ring inside the LWT collars, using a pumpdown assembly and the latching mechanism.

A latching apparatus is provided for conveying and securing a pumpdown assembly to a landing element. In use, the latching apparatus is forced down an inner annulus of a drilling tubular, and latches onto a landing element positioned in a bottom hole assembly (BHA) of the drilling tubular, thereby securing the latching apparatus to the landing element. The latching apparatus may be decoupled from the landing element, that is, the latching apparatus may be releasably securable to the landing element, in an embodiment without disassembly of the BHA.

With reference to FIGS. 1-9C, a latching apparatus 2 may have a body 5, and a fin 9 biased to protrude radially from the body. Fin 9 may be so biased by a biasing element, such as spring 7, between the fin and a surface of the body. There may be any number of fins. In the illustrated embodiment, four fins 9 are positioned evenly apart from one another around the body 5. It is to be understood that the description of the fin 9 in this specification may apply to any one or more fins in a given embodiment of the apparatus.

Body 5 may be a substantially cylindrical and elongate. Body 5 may have first segment 2*a* with a first inner diameter, and a second segment 2*b* with a second inner diameter. The second inner diameter may be greater than the first inner diameter. The inner diameter may taper between the first segment and the second segment. The outer surface of the body may have flattened portions for engagement with vices and other apparatus, for example, for assembly and repair. The body may be coupleable, for example at an end of segment 2*a*, to a pumpdown rod 30 of the pumpdown assembly. The body may be coupleable, for example at an end of segment 2*b*, to logging tools.

Body 5 may include a body-fin recession 5*b* for receiving at least a portion of fin 9. Body-fin recession 5*b* may positioned on an outer surface of the body 5. Body-fin recession 5*b* may be substantially rectangular in cross section. Body 5 may include a body-spring recession 5*a* for coupling to spring 7. Body-spring recession 5*a* may be substantially circular in cross section. Body 5 may include a latching fin holder 6 for holding the fin 9 within the body-fin recession 5*b*. The latching fin holder 6 may have a substantially U shape, and may fit within a body-latching fin holder recession in the body.

Body 5 may have one or more grooves 36 on its outer surface so that, when within the drilling tubular, fluid in the drilling tubular may pass from one end of the body to the other. In one embodiment, grooves 36 are positioned on the body's outer surface between two fins.

Fin holder rod 8 may go through holes 5*c* in the body on either side of the body-fin recession (each hole extending from an outer surface of the body to an inner surface of the body-fin recession 5*b*), and hole 9*c* in the fin. Fin 9 may thereby be pivotable about fin holder rod 8. Hole 9*c* may be positioned between leading edge 9*d* and inner edge 9*f*. An edge of the fin between edges 9*d* and 9*f* may be rounded to facilitate pivoting of the tin around the fin holder rod 8.

Fin 9 may be substantially triangular, having a leading edge 9*d*, a trailing edge 9*e*, and an inner edge 9*f*. In use, when the latching apparatus is travelling down the drilling tubular toward the landing element, leading edge 9*d* is closer to the landing element than trailing edge 9*e*. An edge between edges 9*d* and 9*e* may be rounded.

Inner edge 9*f* may be coupled to spring 7. Inner edge 9*f* may extend beyond trailing edge 9*e* to form a lip 9*g*. Lip 9*g* may be biased by the string against an inner surface of the body, for example the latching fin holder 6, thereby preventing the inner edge 9*f* from swinging out of the body-fin recession 5*b*.

Fin 9 may include a fin-spring recession 9*a* for coupling to spring 7. Fin-spring recession 9*a* may be substantially circular in cross section. In use, spring 7 is coupled at a first end of the spring to the body-spring recession 5*a* and coupled at a second end of the spring to the fin-spring recession 9*a* to resiliently bias the fin away from the body.

Figure 8A:
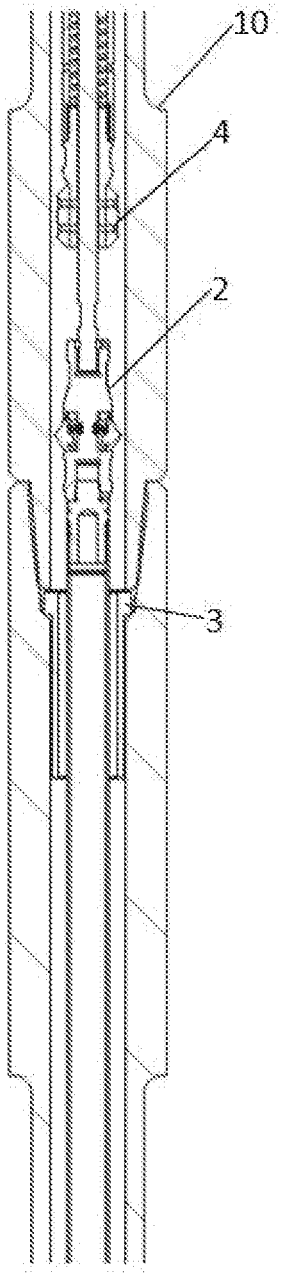
FIG. 8A is a cross sectional view of a latching apparatus, according to one embodiment of the present invention, before engagement with the landing ring.
Figure 8B:
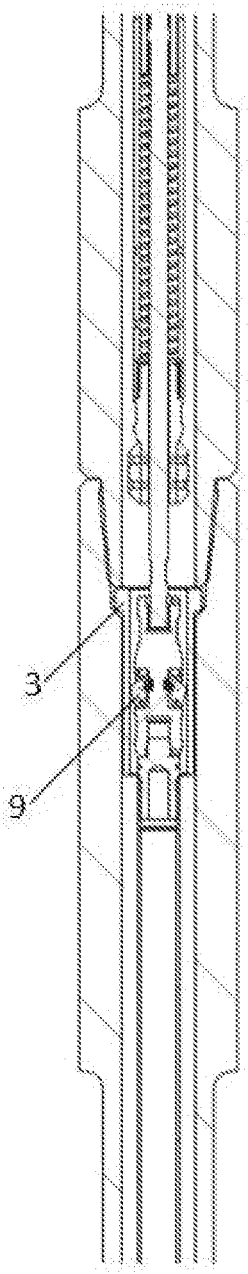
FIG. 8B is a cross sectional view of the embodiment of FIG. 8A, during engagement with the landing ring.
Figure 8C:
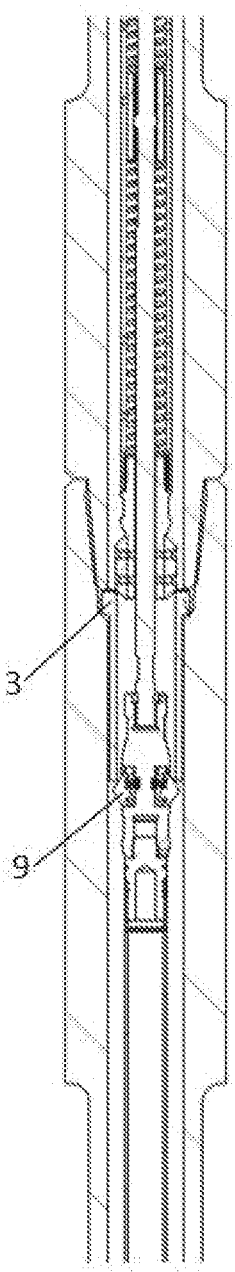
FIG. 8C is a cross sectional view of the embodiment of FIG. 8A, after engagement with the landing ring.
Figure 9A:
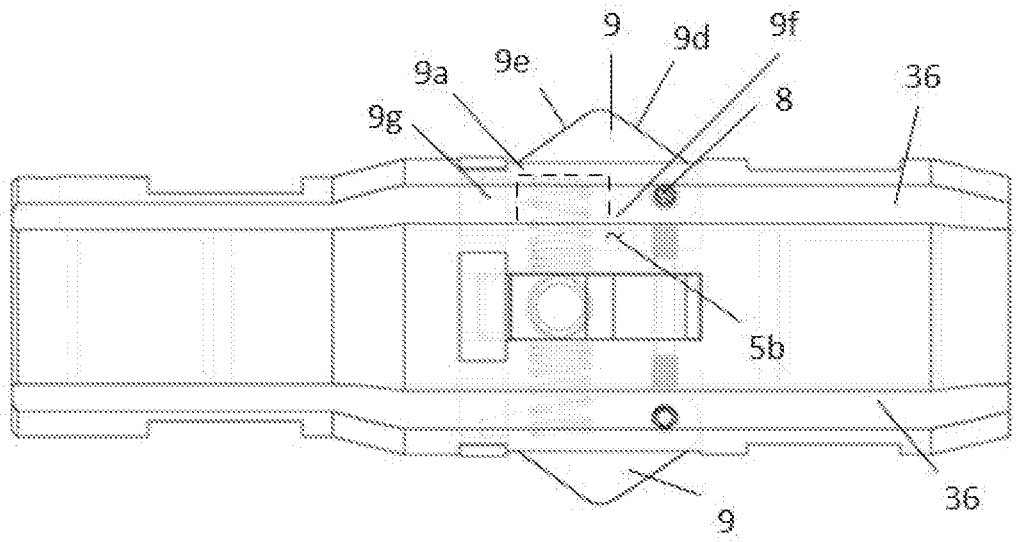
FIG. 9A is a side elevation view of the embodiment of FIG. 1, with its fins expanded, and some interior components illustrated in phantom.
Figure 9B:
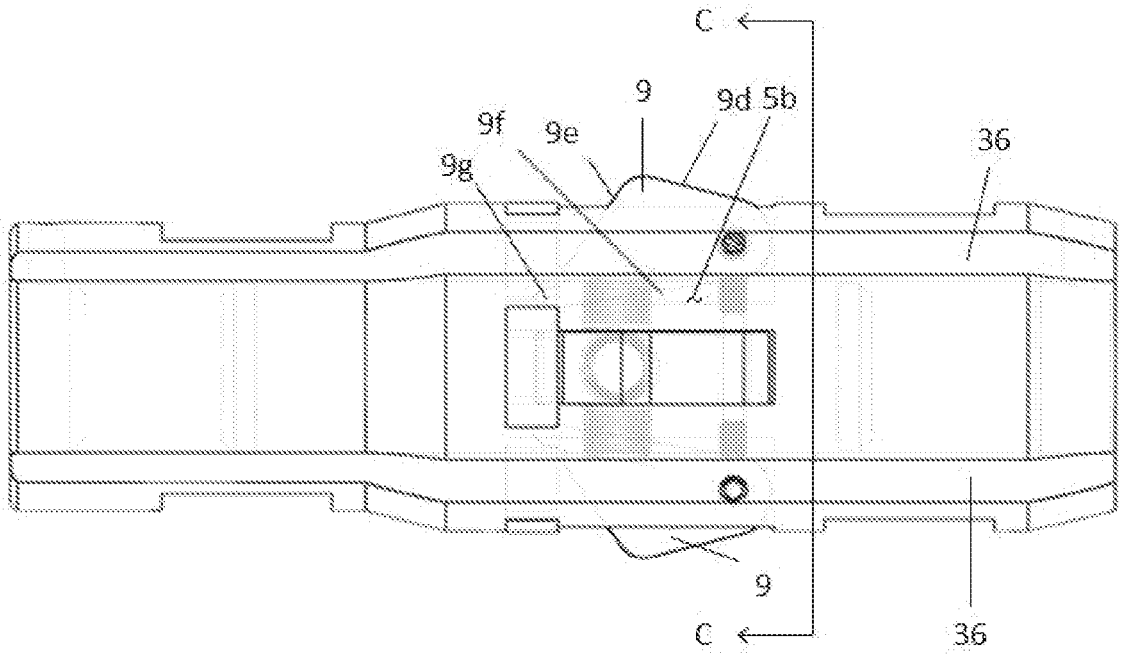
FIG. 9B is a side elevation view of the embodiment of FIG. 9A, with its fins withdrawn, and some interior components illustrated in phantom; and (r)
Figure 9C:
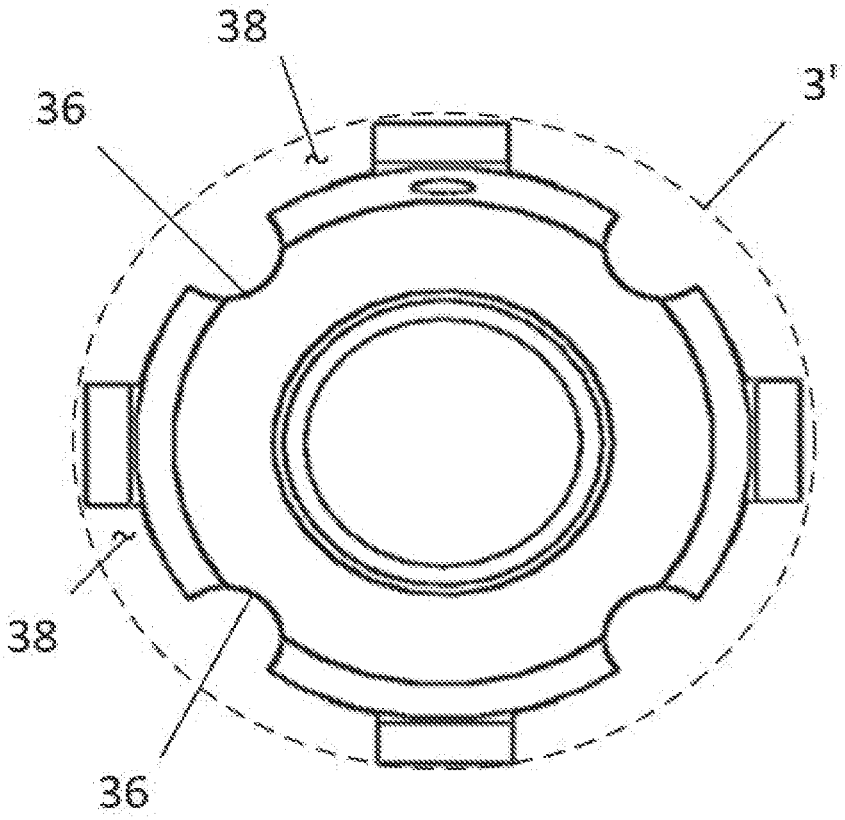
FIG. 9C is a cross sectional view of FIG. 9B along line C-C with dotted lines illustrating an inner diameter of a landing ring according to one embodiment.

With reference to FIGS. 8A-C, the landing ring 3 may have a substantially constant inner diameter. In use, as the latching apparatus is forced down a drilling tubular 10, and enters the landing ring positioned in the drilling tubular 10, leading edge 9*d* of the latching apparatus meets the inner diameter of the landing ring at a first end 3*a* of the landing ring. The inner diameter of the landing ring forces the fin 9 to withdraw further into body-fin recession 5*b*, thereby causing spring 7 to compress. The spring 7 is then biasing the tin against an inner surface of the landing ring, which, as illustrated in FIG. 9C, may thereby define a gap 38, between the outer surface of the body 5 and inner surface 3' of the landing ring, for fluid flow.

Once the fins pass through to the second end 3*b* of the landing ring, spring 7 forces fin 9 to protrude further out of the body-fin recession 5*b*, thereby securing the latching apparatus in place. The latching apparatus may be released, for example, by pulling the latching apparatus out of the hole with exerting sufficient force to overcome the force of the spring on the fins and thereby allow the fins to withdraw into the body-fin recession 5*b*, and thereby allow the latching apparatus to fit through the landing ring.

Various means may be employed to prevent the latching apparatus from travelling too far beyond the second end 3*b* of the landing ring. For example, fin assembly 34 may be positioned on the pumpdown rod at an axial distance from fin 9 substantially the length of the landing ring. Once fins 7 are in their expanded position on side 3*b* of the landing ring, fins of fin assembly 34 meet end 3*a* of the landing ring, thereby securing the latching mechanism axially in place relative to the landing ring.

The force required to insert the latching apparatus into, and remove it from, the landing ring may be selected, for example by varying one or more of the following: the position of the fin holder rod 8, the angle θ of leading edge 9*d* with respect to the landing ring's axis, the angle θ' of trailing edge 9*e* with respect to the landing ring's axis, the position of the spring 7 on the inner edge 9*f*, and/or the strength of the spring 7. In the illustrated embodiment, substantially less force is required to insert the latching apparatus into the landing ring than is required to remove the latching apparatus therefrom, due to the following factors: the fin holder rod 8 is positioned away from the trailing edge, spring is coupled to the inner edge 9*f* closer to the trailing edge 9*e* than to leading edge 9*d*, and the angle θ is greater than angle θ'. In addition, the leading end of the latching apparatus may be free, whereas the trailing end of the latching apparatus is coupled to a rod, thereby making it easier to push down hole than to pull out of hole. During testing of the illustrated embodiment, it was observed that 50 lbs of force was required to insert the latching mechanism into the landing ring, and 500 lbs of force was required to remove the latching mechanism from the landing ring.

CLAUSES

Clause 1. A latching apparatus, comprising: a body; a fin, biased to protrude from the body; and a biasing element, having a first end coupled to the fin and a second end coupled to the body, for biasing the fin radially from the body.

Clause 2. The apparatus of any one or more of clauses 1-8, further comprising: a fin holder for coupling the fin to the body.

Clause 3. The apparatus of any one or more of clauses 1-8 where the fin is connected at one end by a rod forming an axle about which the fin may rotate a distance.

Clause 4. The apparatus of any one or more of clauses 1-8, further comprising a groove on an outer surface of the body for permitting passage of fluid.

Clause 5. The apparatus of any one or more of clauses 1-8, wherein the body is connectable to a tool.

Clause 6. The apparatus of any one or more of clauses 1-8, wherein the body is connectable to a pumpdown rod.

Clause 7. The apparatus of any one or more of clauses 1-8, wherein: a force required to latch the apparatus to, and release the apparatus from, a landing ring may be adjusted by varying any one or more of: a first angle of a leading edge of the fin with respect to an axis of the landing ring; a second angle of a trailing edge of the fin with respect to the axis; a first position of a connection between the fin and the body; a second position of a connection between the fin and the spring; and a strength of the spring.

Clause 8. A method for securing a tool in a drilling tubular, comprising: connecting the tool to a latching apparatus; pumping the latching apparatus into the drilling tubular; resiliently biasing a fin of the latching apparatus radially outward; and forcing the latching apparatus through a landing ring, during which the landing ring forces the fin to move inward to a withdrawn position, and following which the landing ring may resiliently return to an expanded position.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A latching apparatus, comprising:

a body;

a fin, having a lower leading edge and an upper trailing edge, the fin being biased to protrude from the body and movable between a withdrawn position and an expanded position; and a biasing element, having a first end coupled to the fin and a second end coupled to a recession in the body, for biasing the fin radially from the body;

wherein, when the fin is in the expanded position, the upper trailing edge of the fin is angled obtusely with respect to a long axis of the body.

2. The apparatus of claim 1, further comprising:

a fin holder for coupling the fin to the body.

3. The apparatus of claim 1 where the fin is connected at one end by a rod forming an axle about which the fin is able to rotate a distance.

4. The apparatus of claim 1, further comprising a groove on an outer surface of the body for permitting passage of fluid.

5. The apparatus of claim 1, wherein the body is connectable to a tool.

6. The apparatus of claim 1, wherein the body is connectable to a pumpdown rod.

7. The apparatus of claim 1, wherein:

a force required to latch the apparatus to, and release the apparatus from, a landing ring is adjustable by varying any one or more of:

a first angle of the lower leading edge of the fin with respect to an axis of the landing ring;

a second angle of the upper trailing edge of the fin with respect to the axis;

a first position of a connection between the fin and the body;

a second position of a connection between the fin and the biasing element; and a strength of the biasing element.

* * * * *